US005415278A

United States Patent [19]

Sutherland

[11] Patent Number: 5,415,278

[45] Date of Patent: May 16, 1995

[54] CLIP-TYPE CAN CARRIER

[75] Inventor: Robert L. Sutherland, Kennesaw, Ga.

[73] Assignee: Riverwood International Corporation, Atlanta, Ga.

[21] Appl. No.: 191,239

[22] Filed: Feb. 3, 1994

[51] Int. Cl.[6] ..... B65D 75/00

[52] U.S. Cl. ..... 206/148; 206/153; 206/158; 206/161

[58] Field of Search ..... 206/147, 148, 151, 153, 206/161, 158

[56] References Cited

U.S. PATENT DOCUMENTS

| | | | |
|---|---|---|---|
| 3,156,358 | 11/1964 | Raindrop | 206/153 |
| 3,653,503 | 4/1972 | Arneson | 206/153 |
| 3,897,873 | 8/1975 | Graser | 206/153 |
| 5,103,971 | 4/1992 | Schuster | 206/153 |
| 5,188,225 | 2/1993 | Jorba | 206/148 X |
| 5,201,412 | 4/1993 | Schuster et al. | 206/153 |

*Primary Examiner*—Bryon P. Gehman

[57] ABSTRACT

A carrier for articles such as beverage cans of the type that grip the top portions of the cans so as to suspend them from the carrier. The upper ends of the cans extend through apertures in the bottom panel of the carrier, and the chimes or lips of the cans are engaged by locking tabs surrounding the aperture. One of the tabs of each aperture is foldably connected along the fold line connecting the bottom panel to the adjacent side panel, and the fold lines connecting the top panel to the side panels include slits through which portions of the can chimes protrude.

5 Claims, 2 Drawing Sheets

CLIP-TYPE CAN CARRIER

FIELD OF THE INVENTION

This invention relates to article carriers. More particularly, it relates to a can carrier of the type that grips the upper portion of a plurality of cans so as to suspend them from the carrier.

BACKGROUND OF THE INVENTION

It is known to employ paperboard carriers which grip the top portions of cans so that most of the can height is unenclosed. One such carrier design consists of a top panel spaced from a bottom panel by short side panels, with the tops of the cans located in the space between the top and bottom panels. The cans are introduced to the carrier through apertures in the bottom panel and typically are held in place by support tabs which extend up from the bottom panel to engage the underside of the chimes. Finger openings in the top panel enable the carrier to be lifted and carried.

Paperboard carriers of this type are more comfortable to carry than the thin plastic carriers which are sometimes used to grip the top portions of beverage cans. They are inexpensive to manufacture, are environmentally acceptable and include a substantially unbroken top panel surface which provides ample space for printed indicia. It is difficult, however, particularly with newer can designs which feature a longer very steep taper between the main can body and the can top, to engage the can chimes with support tabs throughout the circumference of the cans. It is therefore an object of the invention to provide a carrier of this type which readily supports the cans substantially throughout their circumference. Another object is to more tightly hold the cans in place within the carrier.

SUMMARY OF THE INVENTION

A plurality of articles, each of which has an inwardly tapered upper portion and an outwardly projecting lip, are contained in a carrier comprised of a top panel, a bottom panel spaced from the top panel and side panels connecting the top and bottom panels along fold lines. The width of the bottom panel is greater than the width of the top panel so that the side panels slope inwardly toward the top panel. The bottom panel includes a plurality of apertures through which the upper portion of the articles extends. A plurality of support tabs connected to the bottom panel along fold lines adjacent the apertures engage the lips of the articles, and at least one of the tabs of an aperture is in contact with the adjacent side panel. This arrangement results in the outer support tabs being pushed in toward the articles by the side panels, strengthening the package. Preferably, the fold line of the support tabs in contact with the adjacent side panel is coincident with the fold line connecting the side panel to the bottom panel.

The carrier may also include a plurality of slots coincident with the fold line connecting the top panel to the side panels for receiving a portion of the outwardly projecting lip of an adjacent article. This allows the top panel to be drawn very tightly when wrapping the carrier blank around the articles prior to adhering the ends of the blank together.

In a preferred design the support tabs are symmetrically arranged around the apertures in the bottom panel. This results in a support tab similar to the tab in contact with the adjacent side panel being located on the opposite side of the aperture. Preferably, the fold lines connecting both of these oppositely located support tabs to the bottom panel include straight parallel portions. Spaced finger holes may be provided in the top panel for carrying the package.

The features of the invention responsible for producing the strong, tightly wrapped carrier of the invention are brought out in more detail below in connection with the preferred embodiment, wherein the above and other aspects of the invention, as well as other benefits, will readily become apparent.

DETAILED DESCRIPTION OF THE PREFERRED EMBODIMENT

Figure 1:
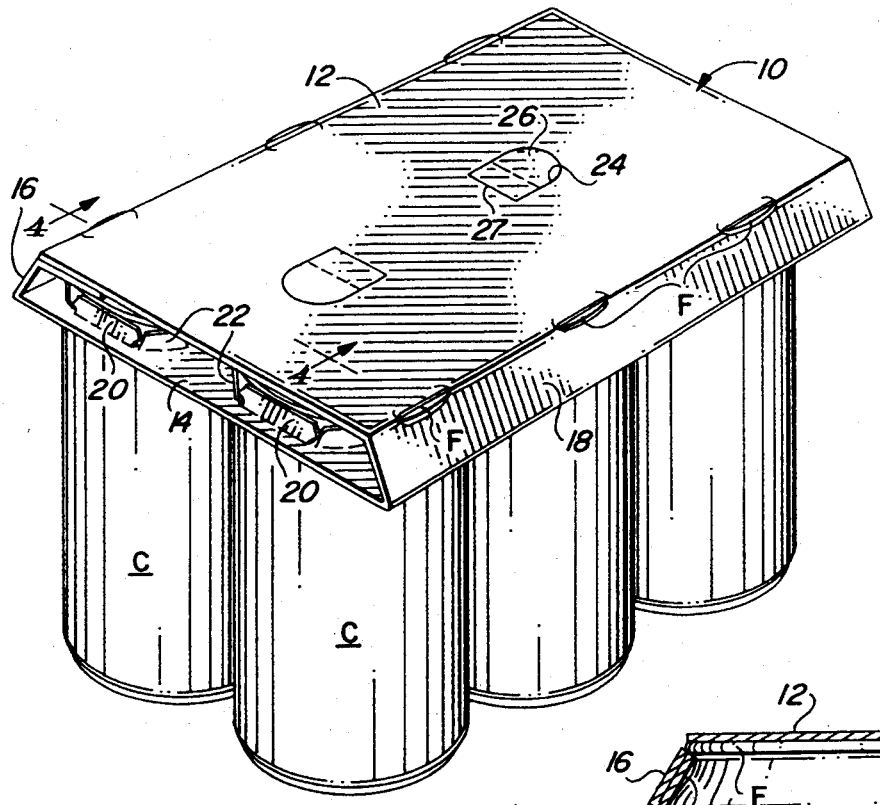
FIG. 1 is a pictorial view of a carrier incorporating the can support means of the present invention.

Referring to FIG. 1, a carrier 10 is comprised of a top panel 12 connected to bottom panel 14 by side panels 16 and 18. The upper portions of cans C extend through openings in the bottom panel 14 and are supported by a number of support tabs, and portions of the can chimes F extend through slots in the carrier. Most of the support tabs are not visible in this view, although end tabs 20 and portions of adjacent tabs 22 can be seen. The side panels are very short, resulting in only a small space between the top and bottom panels where the cans are supported. Finger holes 24, covered by tabs 26 which are foldably connected to the top panel at 27, facilitate lifting the carrier.

Figure 2:
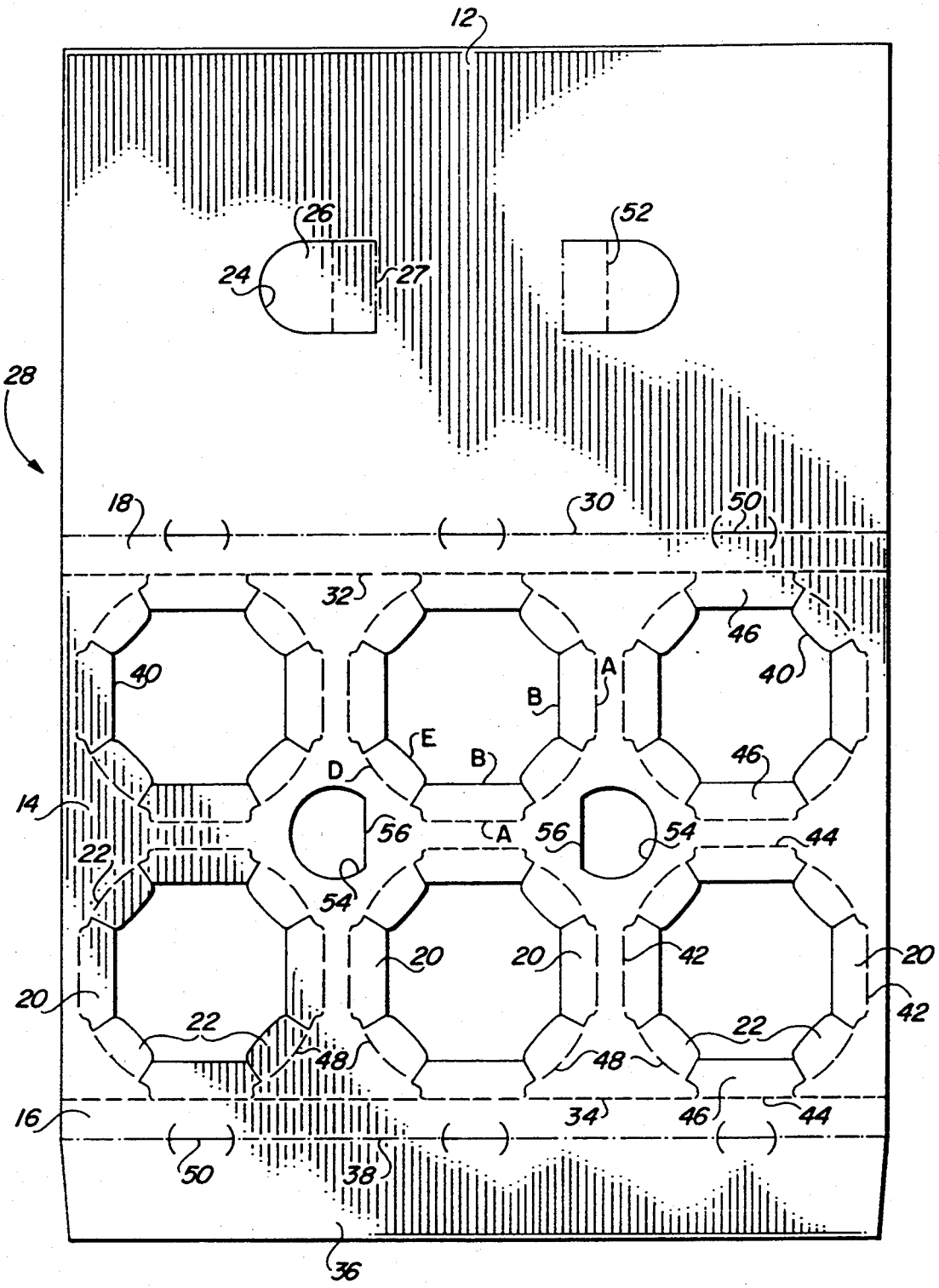
FIG. 2 is a plan view of a blank for forming the carrier of FIG. 1.

Referring to FIG. 2, wherein like reference numerals to those used in FIG. 1 denote like structure, the carrier is formed from a rectangular blank 28 of flexible sheet material, such as paperboard. The blank is divided into a top panel section 12, a bottom panel section 14 and side panel sections 16 and 18. The top panel section 12, which is somewhat narrower than the bottom panel section 14, is connected to the side panel section 18 by fold line 30, and the side panel section is connected to the bottom panel section 14 by parallel fold line 32. The side panel section 16 is connected to the bottom panel section 14 by fold line 34 and to glue flap 36 by fold line 38.

The bottom panel section 14 is provided with two rows of three apertures 40 to form a grouping of six adjacent apertures. Each aperture is ringed by a series of support tabs connected to the bottom panel along fold lines forming the boundary of the aperture. Thus, each aperture is defined by the fold lines 42 of opposite support tabs 20, the fold lines 44 of opposite support tabs 46 and the fold lines 48 of the support tabs 22. The support tabs 22 are located between the tabs 20 and 46, with the interior tab fold lines 44 being parallel to and spaced from each other by a short distance and the outer tab fold lines 44 being coincident with the fold lines 34 and 32. Short H-shaped slits 50 are provided in the fold lines 30 and 38 opposite the tabs 46 for receiving portions of the can chimes as described above.

The fold lines 48 of the tabs 22 follow a circular arc whose center of radius is at the center of the can aperture. Although the fold lines 42 and 44 of the tabs 20 and 46 are not arcuate but rather are parallel to the end and side edges of the carrier, the midpoint of these fold lines lies on the same circular arc. This midpoint is designated as A in the upper center aperture shown in FIG. 2. The width of the support tabs, as measured across the midpoint of a tab, is the same. Thus, although the inner edges of the tabs are staggered with respect to adjacent tabs, the width AB of the tabs 20 and 46 is the same as the width DE of the tabs 22. This arrangement takes into account the curvature of the tabs after they have been pushed out of the plane of the bottom panel and allows all the tabs of an aperture to contact the chime of an associated can.

The finger holes 24 and the flaps 26 in the top panel section 12 are elongated, and the flaps include a transverse fold line 52 intermediate the ends of the flaps. Additional finger holes 54 are located in the bottom panel section 14 in the space between the interior and end can apertures. The inwardly facing edges 56 of the finger holes 54 are straight and extend at substantially right angles to the fold lines 32 and 34.

Figure 3:
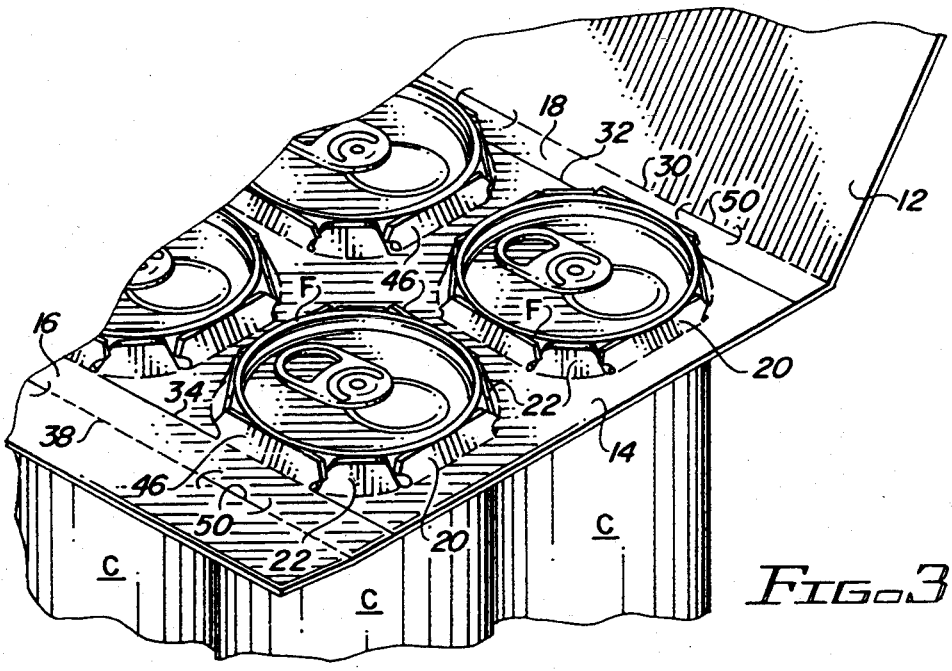
FIG. 3 is a partial pictorial view showing the support tabs of the invention engaging beverage cans supported by the carrier.

To form a package, the blank of FIG. 2 is positioned on top of a group of six adjacent cans which have been arranged in two rows of three each so that the apertures 40 overlie the cans. Relative movement between the apertures and the cans is caused by applying downward pressure to the bottom panel section. The relative upward movement of the tops of the cans pushes the support tabs up until they engage the bottom of the can chimes F, as illustrated in FIG. 3. The resiliency or memory of the tabs causes them to be biased toward the cans so that the support tab edges remain in contact with the underside of the can chimes. As shown, the tabs are separated slightly as a result of their upward pivoting movement, but still are so closely spaced that they provide substantially continuous support around the circumference of the adjacent portion of the can chime.

Figure 4:
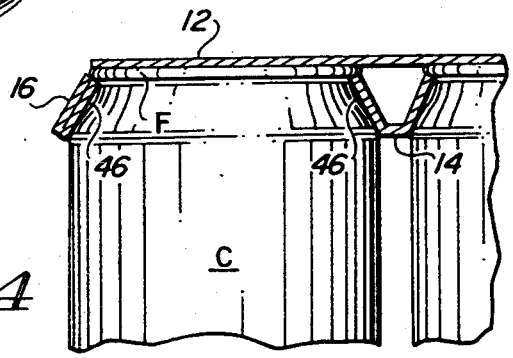
FIG. 4 is a partial transverse sectional view of the carrier taken along line 4—4 of FIG. 1.

After the blank has been moved down over the can tops to actuate the support tabs the blank is folded along lines 30, 32, 34 and 38 to form the side panels. This action folds the glue flap 36 down along the fold line 38 into its final position so that it engages the underside of the top panel 12. It will be understood that prior to the folding operation glue will have been applied to either the glue flap 36 or the area of the top panel that engage the glue flap. Because the bottom panel is wider than the top panel the side panels slope inwardly, pushing the adjacent support tabs 46 against the cans. Thus, as illustrated in FIG. 4, the support tabs 46 contact both the side panels 18 and the upper tapered portion of the cans. It will be understood that the other support tabs surrounding an aperture also contact the upper tapered portion of the cans to hold them tightly in place, but only the outer tabs 46 are buttressed by the side panels. Also, the narrow top panel and the presence of the slits 50 in the fold line 30 results in outer portions of the can chimes extending through the slits, which enables the top panel to be drawn tightly into place prior to the setting of the glue. H-shaped slits are preferred over linear slits because the arcuate transverse cuts at their ends prevents the slits from tearing.

To lift a package of cans, one merely inserts the fingers through the finger holes in the top panel, pushing the end of the finger hole tabs 26 down through the aligned holes 54 in the bottom panel. The tabs fold along the transverse fold lines 52 under the edge 56 of the aligned finger hole 54 to provide support for the fingers when lifting and carrying the package.

It will now be clear that the invention improves the ability of paperboard carriers to carry cans by their top portions, and guards against the cans coming loose by supporting them substantially entirely about their entire periphery. The common fold lines of the side support tabs and the side panels and the fact that the side panels are inwardly sloped cause the side support tabs to be pushed into engagement with the can chimes. Further, the slots in the side panel fold lines allows the top panel to be tightly drawn into place to more securely hold the cans.

It will be understood that although the invention has been described in connection with a carrier adapted to hold a group of beverage cans, the carrier could be designed to hold other types of flanged articles. Although the carrier can be designed to hold fewer or more cans than six, each can should be engaged by a support tab which is adjacent a side panel.

It should now be appreciated that the invention need not necessarily be limited to all the specific details described in connection with the preferred embodiment, but that changes to certain features which do not alter the overall basic function and concept of the invention may be made without departing from the spirit and scope of the invention defined in the appended claims.

What is claimed is:

1. A package containing a plurality of articles arranged in two adjacent rows, each article having an inwardly tapered upper portion including an outwardly projecting lip, comprising:

a carrier comprised of a top panel, a bottom panel spaced from the top panel and side panels connecting the top and bottom panels along substantially straight fold lines, each side panel being adjacent one of the rows of articles;

the bottom panel having a width, as measured between the side panels, greater than the width of the top panel so that the side panels slope inwardly toward the top panel;

the bottom panel containing a plurality of apertures through which the upper portions of the articles extend;

a plurality of support tabs connected to the bottom panel along fold lines adjacent to and substantially surrounding each of the apertures, the support tabs engaging the lips of the articles; and the fold line of one of the support tabs associated with each aperture being coincident along its entire length with the fold line connecting the adjacent side panel to the bottom panel, said one support tab being in contact with the adjacent side panel substantially throughout the entire extent of said one support tab and also being in contact with the inwardly tapered upper portion of the associated article.

2. A package as defined in claim 1, wherein the carrier includes a plurality of slots coincident with the fold line connecting the top panel to the side panels, each slot being opposite one of the articles and receiving a portion of the outwardly projecting lip of said one article.

3. A package as defined in claim 1, wherein the articles are beverage cans.

4. A blank capable of being formed into a carrier for supporting a plurality of articles each of which includes an inwardly tapered upper portion having an outwardly projecting lip, comprising:

a top panel section;

a bottom panel section;

a first side panel section connected to the top and bottom panel sections along substantially straight fold lines;

a second side panel section connected along substantially straight fold lines to a glue flap which is overlapped by and adhered to the top panel section in a carrier formed from the blank;

the bottom panel section having a width greater than the width of the top panel section so that the side panels of a carrier formed from the blank slope inwardly toward the top panel;

the bottom panel section containing a plurality of apertures adapted to receive the upper portions of the articles, the apertures being arranged in two adjacent rows, each row being adjacent a side panel section;

a plurality of support tabs connected to the bottom panel along fold lines adjacent to and substantially surrounding each of the apertures, the support tabs adapted to be folded out of the plane of the bottom panel by articles being moved into position through the apertures and to engage the outwardly projecting lips of the associated articles; and the fold line of one of the support tabs of each aperture being coincident along its entire length with the fold line connecting the adjacent side panel section to the bottom panel section so as to cause said one support tab to be in contact with the adjacent side panel section in a carrier formed from the blank substantially throughout the entire extent of said one support tab.

5. A blank as defined in claim 4, wherein the fold line connecting the top panel section to the first side panel section and the fold line connecting the glue flap to the second side panel section include a plurality of slits coincident therewith for receiving a portion of the outwardly projecting lip of an adjacent article in a carrier formed from the blank.

* * * * *